US006324836B1

(12) United States Patent
Nakagawa et al.

(10) Patent No.: US 6,324,836 B1
(45) Date of Patent: Dec. 4, 2001

(54) APPARATUS AND METHOD FOR CONTROLLING AIR-TO-FUEL RATIO IN ENGINE

(75) Inventors: Shinji Nakagawa, Hitachinaka; Toshio Ishii; Yutaka Takaku, both of Mito; Minoru Ohsuga; Hiroyuki Takamura, both of Hitachinaka, all of (JP)

(73) Assignees: Hitachi, Ltd., Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 0 days.

(21) Appl. No.: 09/592,852

(22) Filed: Jun. 12, 2000

(30) Foreign Application Priority Data

Jun. 10, 1999 (JP) ..... 11-163442

(51) Int. Cl.[7] ..... F01N 3/00
(52) U.S. Cl. ..... 60/285; 60/274; 60/277
(58) Field of Search ..... 60/274, 277, 285

(56) References Cited

U.S. PATENT DOCUMENTS 5,379,590 * 1/1995 Hamburg et al. ..... 60/285
5,383,333 * 1/1995 Logothetis et al. ..... 60/285
5,537,816 * 7/1996 Ridgway et al. ..... 60/274
5,758,490 * 6/1998 Maki et al. ..... 60/274
6,073,073 * 6/2000 Kitamura et al. ..... 60/285
6,076,348 * 6/2000 Falandino et al. ..... 60/285
6,089,016 * 7/2000 Takaku ..... 60/285
6,116,023 * 9/2000 Ishizuka et al. ..... 60/285

FOREIGN PATENT DOCUMENTS 5-171924 7/1993 (JP) .
9-72235 3/1997 (JP) .
10-184426 7/1998 (JP) .

* cited by examiner

*Primary Examiner*—Thomas Denion
*Assistant Examiner*—Diem Tran
(74) *Attorney, Agent, or Firm*—Crowell & Moring LLP

(57) ABSTRACT

If the output of an $O_2$ sensor located downstream of a catalyst deviates from a predetermined range, the air-to-fuel ratio upstream of the catalyst is over-corrected to be a leaner value or a richer value beyond the predetermined purification-efficiency range when the output of the $O_2$ sensor downstream of the catalyst indicates rich or lean, respectively, so that the output of the O sensor downstream of the catalyst returns within a predetermined range as soon as possible.

19 Claims, 17 Drawing Sheets

APPARATUS AND METHOD FOR CONTROLLING AIR-TO-FUEL RATIO IN ENGINE

BACKGROUND OF THE INVENTION

The present invention relates to an apparatus for controlling an engine, and especially to an apparatus and a method for quickly correcting an air-to-fuel ratio (hereafter referred to as an A/F ratio) when the purification state of exhaust gas is deteriorated downstream of a catalyst unit located in an exhaust pipe.

A catalyst unit including a three way catalyst, which oxidizes HC and CO and deoxidizes Nox in exhaust gas expelled from the engine, is generally located in the exhaust pipe of the engine. Rare metals such as Pt, Pd, Rh, etc., are used for the catalyst, and impurities such as HC, CO, and NOx are efficiently purified only in a very narrow region near the stoichiometric A/F ratio as shown in FIG. 2. This is because it is necessary that the oxidizing substances and the deoxidizing substances exist in a balance. Accordingly, a typical promoter: ceric oxide is added to the three way catalyst to expand the narrow highly-efficient-purification region near the stoichiometric A/F ratio. Ceric oxide is oxygen-trapping material which absorbs or stores oxygen. Further, ceric oxide discharges oxygen in a deoxidizing atmosphere, that is, in a region where the A/F ratio is richer than the stoichiometric ratio, and traps oxygen in an oxidizing atmosphere, that is, in a region where the A/F ratio is leaner than the stoichiometric ratio, which in turn expands the region in which the oxidizing substances and the deoxidizing substances can exist in a balance as shown in FIG. 3. Furthermore, to hold the components of exhaust gas expelled from the engine within the highly-efficient-purification region under various operational conditions, and $O_2$-sensor for detecting whether the A/F ratio of the exhaust gas is leaner or richer than the stoichiometric ratio is located in the exhaust pipe as shown in FIG. 4, and an A/F ratio feed-back control (hereafter referred to as an A/F ratio F/B control) is performed based on the output of the $O_2$-sensor in order to control the fuel-injection amount so that the A/F ratio in the combustion room is held at the stoichiometric ratio. Recently, an A/F ratio F/B control method using a linear A/F sensor whose output is linearly proportional to the A/F ratio of the exhaust gas as shown in FIG. 5 has been also practically applied.

Although the above A/F ratio F/B control is aimed at keeping the A/F ratio upstream of the catalyst at the stoichiometric ratio, it is known that the three-way performance of the catalyst is improved by an in-catalyst atmosphere-control concerning the oxygen trapped in the ceric oxide ($CeO_2$). Since ceric oxide deoxidizes Nox or traps $O_2$ in the oxidizing atmosphere as shown in the chemical equations (1) and (2), and oxidizes CO or discharges $O_2$ in the deoxidizing atmosphere as shown in the chemical equations (3) and (4), ceric oxide can simultaneously remove HC, CO, and Nox.

$$Ce_2O_3+\tfrac{1}{2}O_2 \rightarrow 2CeO_2 \quad (1)$$

$$Ce_2O_3+NO \rightarrow 2CeO_2+N_2 \quad (2)$$

$$2CeO_2 \rightarrow Ce_2O_3+\tfrac{1}{2}O_2 \quad (3)$$

$$2Ce_2O_3+CO \rightarrow CeO_2+CO_2 \quad (4)$$

Therefore, to improve the purification performance, it is important to keep not only the A/F ratio upstream of the catalyst but also the balance of the amounts of $CeO_2$ and $Ce_2O_3$ in the catalyst. Japanese Patent Application Laid-Opens Hei 9-72235 and Hei 10-184436 have devised respective control methods in which the amount of ceric oxide in the catalyst is controlled by adjusting the chemical atmosphere in the catalyst. However, since it is difficult to keep the A/F ratio upstream of the catalyst within the highly-efficient-purification region under all operational conditions, the A/F ratio upstream of the catalyst may shift largely from the stoichiometric ratio in the lean or rich direction, and the balance of the amounts of $CeO_2$ and $Ce_2O_3$ can be frequently lost. In such cases, although the A/F ratio upstream of the catalyst should be quickly returned to the stoichiometric ratio, it is also important to return the amount of the ceric oxide to the desired value. Quickly returning the amount of the ceric oxide to the desired value can be realized by improving the response of the A/F control at the outlet region of the engine. However, as mentioned above, the ceric oxide sometimes degrades the response of change in the A/F ratio in the catalyst. That is, when the A/F ratio upstream of the catalyst changes from the stoichiometric ratio to a richer value, oxygen is discharged from the ceric oxide in the catalyst while the deoxidizing atmosphere is strengthened, which in turn hinders the strengthening of the deoxidizing atmosphere. Conversely, when the A/F ratio upstream of the catalyst changes from the stoichiometric ratio to a leaner value, oxygen is trapped or stored by the ceric oxide in the catalyst while the oxidizing atmosphere is strengthened, which in turn hinders the strengthening of the oxidizing atmosphere. This is confirmed by the phenomena that a phase delay can be observed in the changes in the A/F ratios before and after the catalyst when the A/F ratio upstream of the catalyst is changed. Since the transient response of the ceric oxide in the catalyst is not taken into account in the conventional control to return the A/F ratio upstream of the catalyst to the stoichiometric ratio, the optimal response of the A/F ratio in the catalyst is not realized, and the quality degradation of the exhaust gas cannot be corrected.

SUMMARY OF THE INVENTION

An objective of the present invention is to quickly recover the quality degradation of the exhaust gas by correcting the A/F ratio upstream of the catalyst such that the response of the A/F ratio downstream of the catalyst is the fastest possible, considering the effects of the ceric oxide as a promoter, when the A/F ratio downstream of the catalyst deviates from the highly-efficient purification region of the catalyst.

The above objective is achieved to provide an air-to-fuel ratio control apparatus comprising: a catalyst unit for purifying exhaust gas from an engine; air-to-fuel ratio-detection means for detecting at least an air-to-fuel ratio downstream of the catalyst unit; a first control means for controlling at least one of an amount of fuel and an amount of air to be fed to the engine by using a feed-back control based on at least one of air-to-fuel ratios upstream of, downstream of, and in the catalyst unit; and a second control means for controlling an air-to-fuel ratio upstream of the catalyst unit so as to be within a predetermined purification-efficiency range after over-correcting the air-to-fuel ratio upstream of the catalyst unit so as to be a richer value beyond the predetermined purification-efficiency range, if an output of the air-to-fuel ratio-detection means deviates from a predetermined range, and an air-to-fuel ratio downstream of the catalyst unit in lean.

Further, the present invention provides an air-to-fuel ratio control apparatus comprising: a catalyst unit for purifying exhaust gas from an engine; air-to-fuel ratio-detection means for detecting at least air-to-fuel ratio downstream of the catalyst unit; a first control means for controlling at least one of an amount of fuel and an amount of air to be fed to the engine by using a feed-back control based on at least one of air-to-fuel ratios upstream of, downstream of, and in the catalyst unit; and a second control means for controlling an air-to-fuel ratio upstream of the catalyst unit so as to be within a predetermined purification-efficiency range after over-correcting the air-to-fuel ratio upstream of the catalyst unit so as to be a leaner value beyond the predetermined purification-efficiency range, if an output of the air-to-fuel ratio-detection means deviates from a predetermined range, and an air-to-fuel ratio downstream of the catalyst unit is rich.

Also, to achieve the above objective, the present invention provides a method of controlling an air-to-fuel ratio in exhaust gas from engine by using a control apparatus including a catalyst unit for purifying exhaust gas of an engine, the method comprising the steps of: detecting at least an air-to-fuel ratio downstream of the catalyst unit; controlling at least one of an amount of fuel and an amount of air to be fed to the engine by using a feed-back control based on at least one of air-to-fuel ratios upstream of, downstream of, and in the catalyst unit; and controlling an air-to-fuel ratio upstream of the catalyst unit so as to be within a predetermined purification-efficiency range after over-correcting the air-to-fuel ratio upstream of the catalyst unit so as to be a richer value beyond the predetermined purification-efficiency range, if an output of the air-to-fuel ratio-detection means deviates from a predetermined range, and an air-to-fuel ratio downstream of the catalyst unit is lean.

Furthermore, the present invention provides a method of controlling an air-to-fuel ratio in exhaust gas from engine by using an apparatus including a catalyst unit for purifying exhaust gas of an engine, the method comprising the steps of: detecting at least an air-to-fuel ratio downstream of the catalyst unit; controlling at least one of an amount of fuel and an amount of air to be fed to the engine by using a feed-back control based on at least one of air-to-fuel ratios upstream of, downstream of, and in the catalyst unit; and controlling an air-to-fuel ratio upstream of the catalyst unit to be within a predetermined purification-efficiency range after over-correcting the air-to-fuel ratio upstream of the catalyst unit so as to be a leaner value beyond the predetermined purification-efficiency range, if an output of the air-to-fuel ratio-detection means deviates from a predetermined range, and an air-to-fuel ratio downstream of the catalyst unit is also rich.

DETAILED DESCRIPTION OF THE EMBODIMENTS

Hereafter, the present invention will be explained with reference to the drawings.

Figure 1:
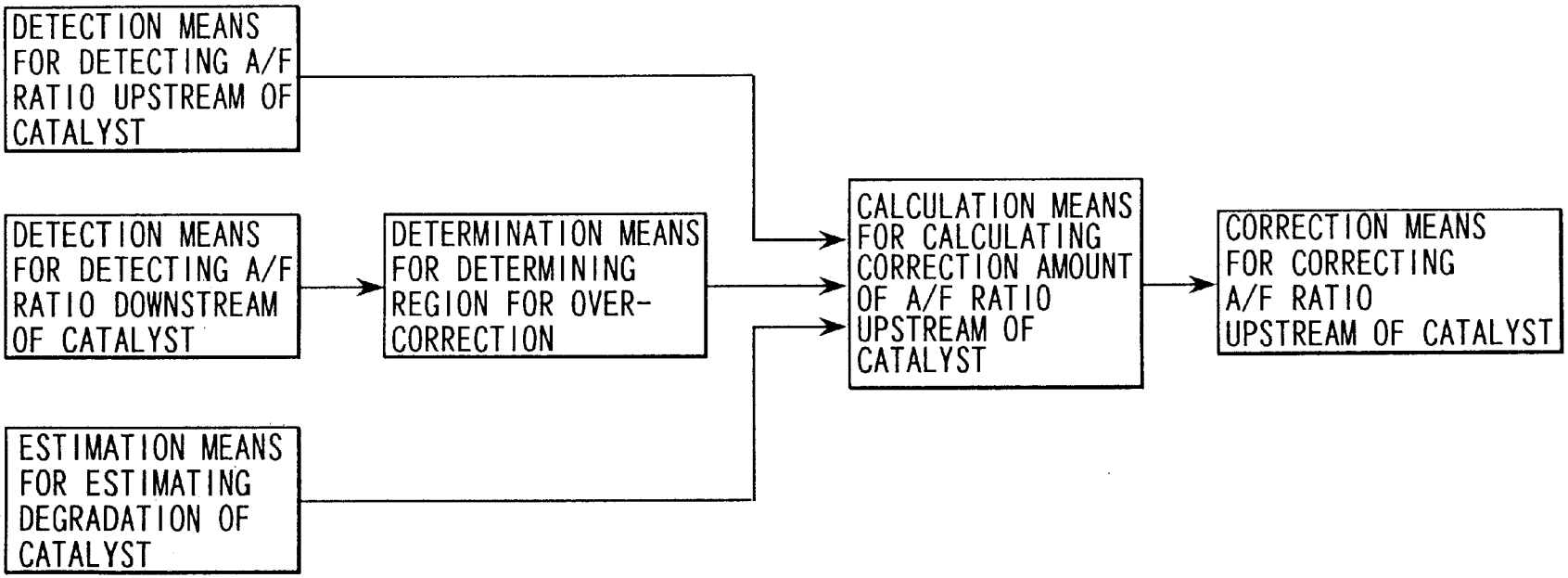
FIG. 1 is a schematic block diagram showing the basic functional composition of an apparatus for controlling the A/F ratio in an engine, according to the present invention.
Figure 2:
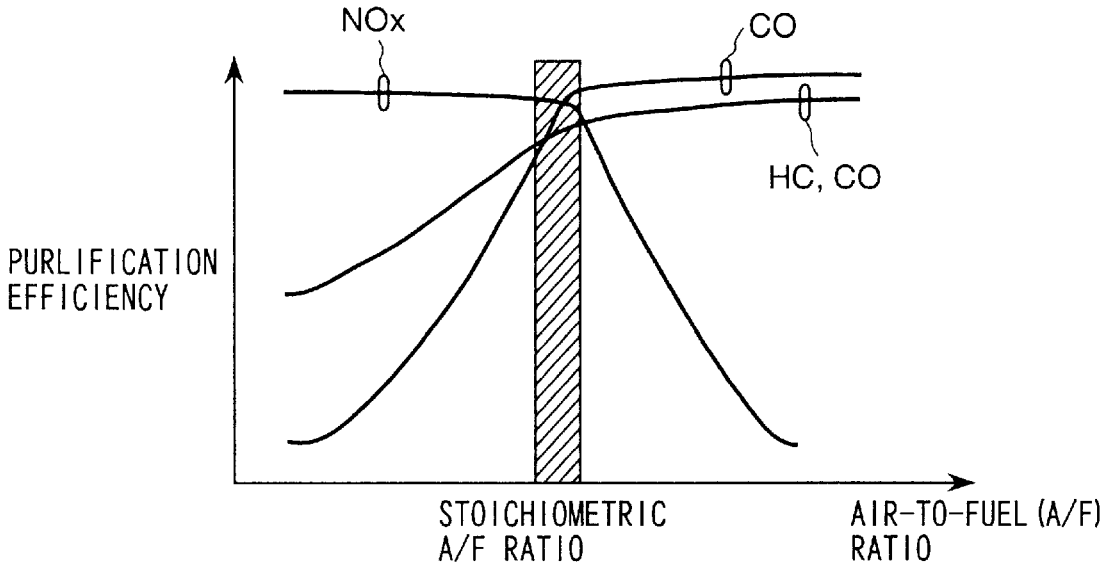
FIG. 2 is a graph showing a highly-efficient-purification region in the case when a catalyst made of only rare metal is used.
Figure 3:
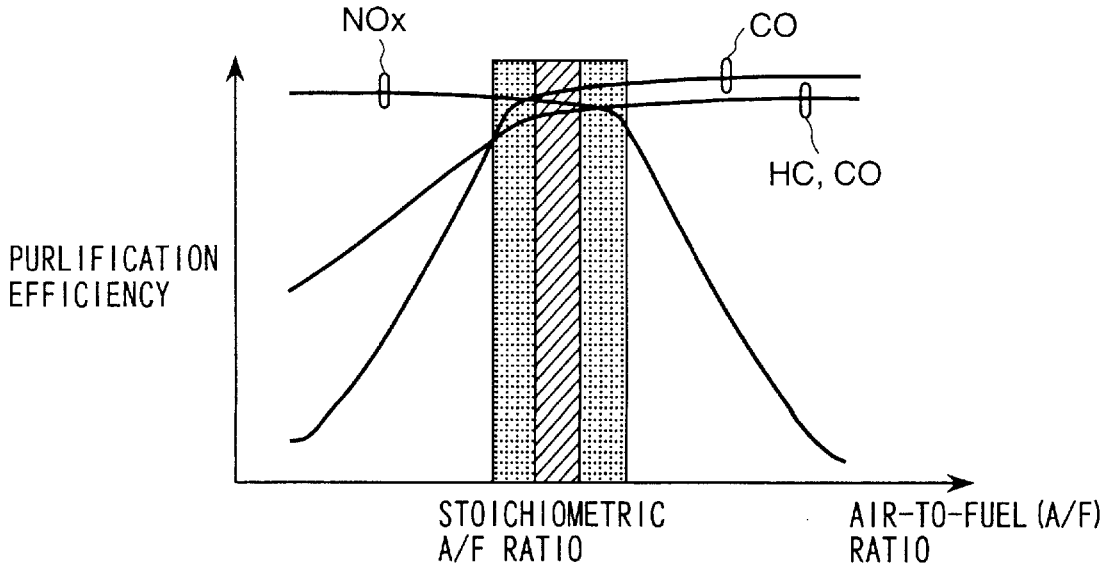
FIG. 3 is a graph showing a highly-efficient-purification region in the case when a promoter of ceric oxide is added to the catalyst.
Figure 4:
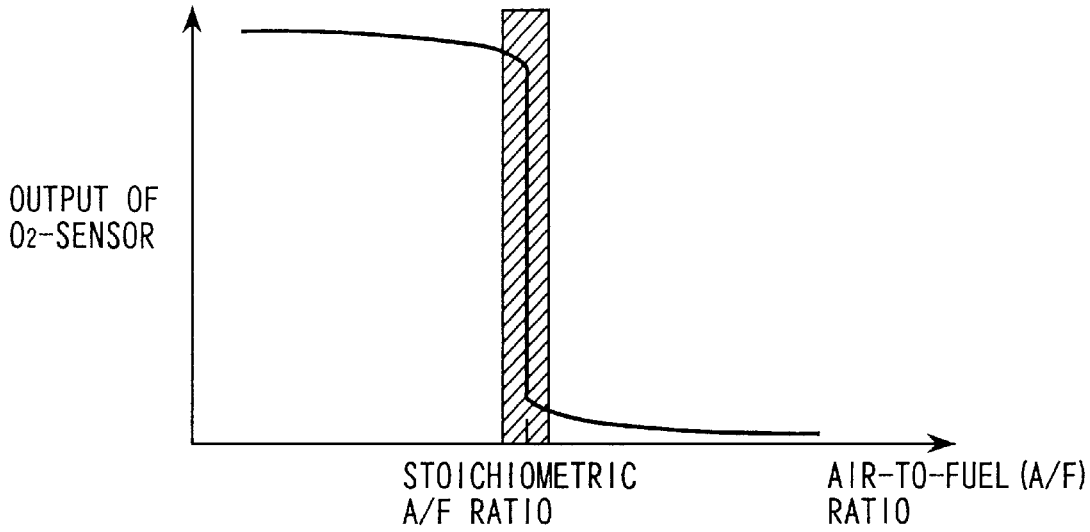
FIG. 4 is a graph showing the output characteristic of an $O_2$ sensor.
Figure 5:
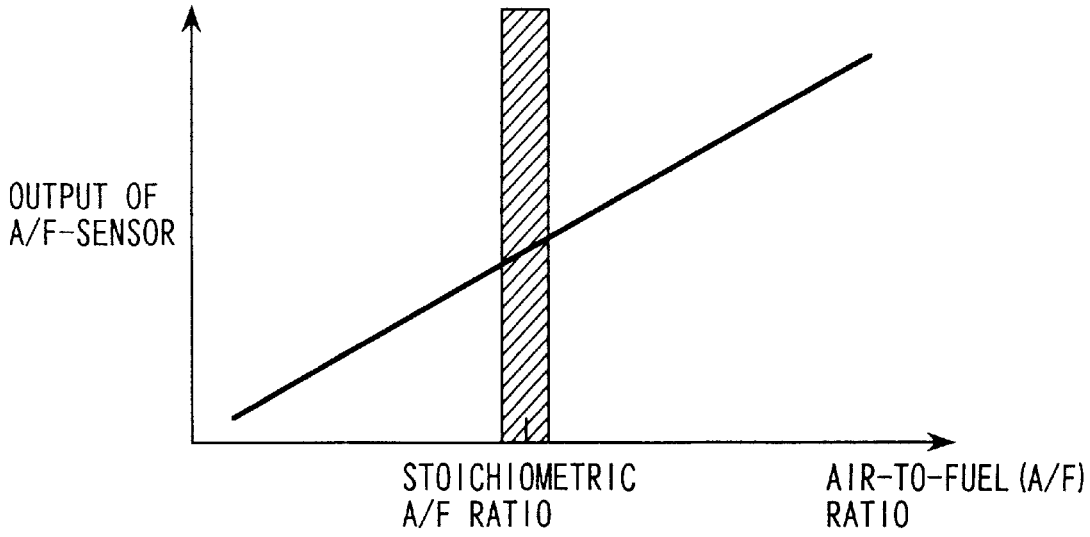
FIG. 5 is a graph showing the output characteristic of an A/F sensor.
Figure 6:
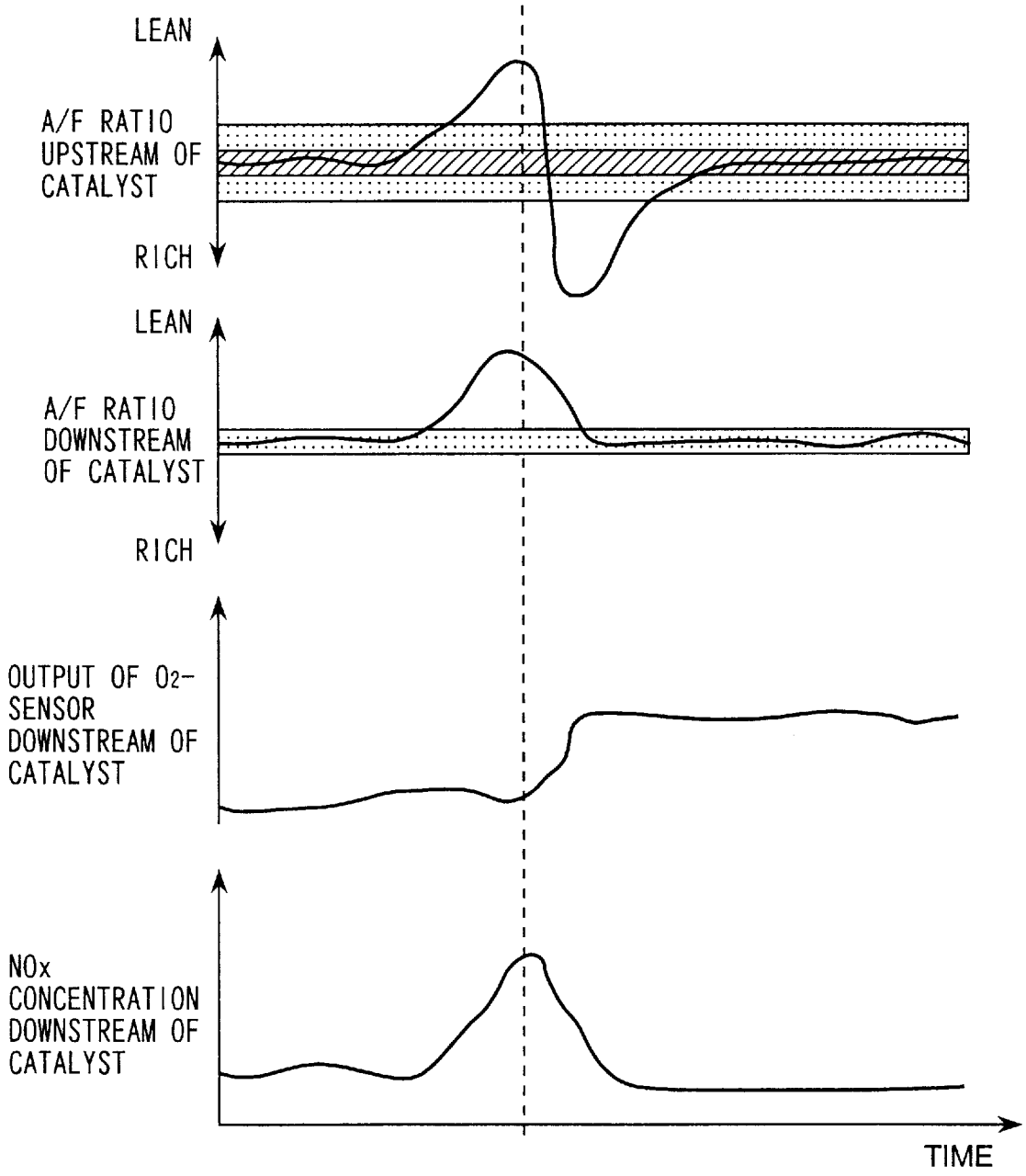
FIG. 6 shows respective time charts of the changes in the A/F ratios upstream of and downstream of the catalyst, the output of the $O_2$ sensor downstream of the catalyst, and the concentration of Nox in the exhaust gas downstream of the catalyst in the case when the A/F ration upstream of the catalyst has been correct from a lean ratio to a rich ratio according to the method of the present invention.
Figure 7:
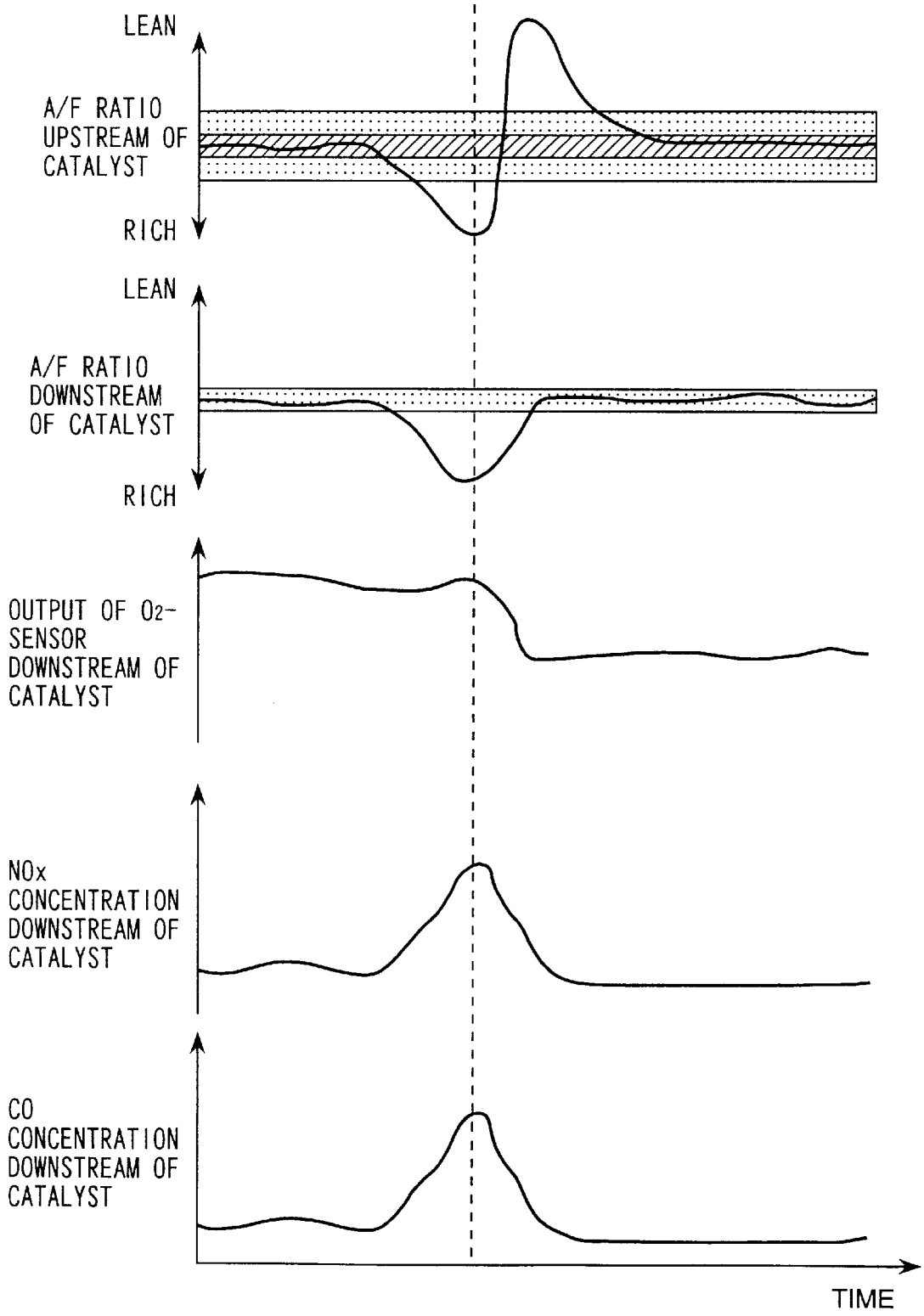
FIG. 7 shows respective time charts of the changes in the A/F ratios upstream of and downstream of the catalyst, the output of the $O_2$ sensor in the exhaust gas downstream of the catalyst, and the concentrations of HC and CO downstream of the catalyst in the case when the A/F ration upstream of the catalyst has been correct from a rich ratio to a lean ratio according to the method of the present invention.
Figure 8:
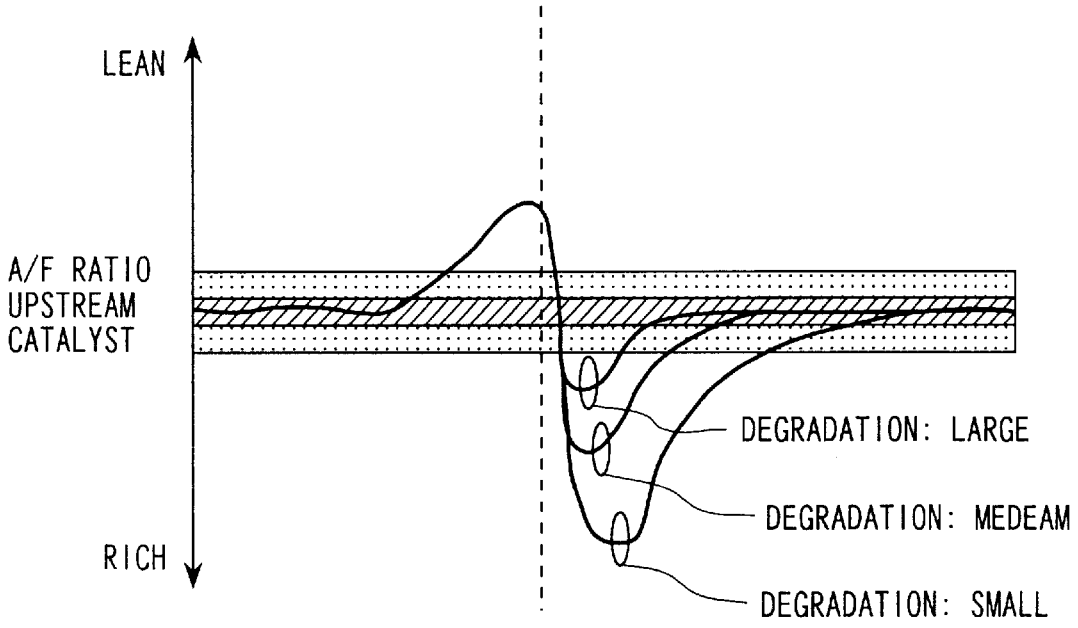
FIG. 8 is an illustration showing the method of changing a correction amount of the A/F ratio at the inlet of the catalyst, corresponding to the degree of degradation of the catalyst.

First, the fundamental concept of the present invention is explained below. For example, the control in the case when the A/F ratio downstream of the catalyst turns to lean during the stopping of fuel injection, transient states of engine operations, or changes in fuel burning states are explained. FIG. 6 shows time charts of the changes of the respective A/F ratios upstream of and downstream of the catalyst, the output of the $O_2$ sensor downstream of the catalyst, and the concentration of Nox in the exhaust gas downstream of the catalyst in the case when the A/F ratio upstream of the catalyst has been corrected from a lean ratio to a rich ratio according to the method of the present invention. That is, if the A/F ratio becomes leaner beyond a predetermined efficient-purification range, for example, the highly-efficient-purification range (the region densely shaded in FIG. 6), the exhaust gas is fed to the catalyst with the A/F ratio such that the maximum reaction rate can be obtained in the catalyst, taking oxygen discharged from the ceric oxide into consideration. Going into more detail, the deoxidizing atmosphere is rapidly strengthened by feeding the exhaust gas with the A/F ratio richer than the stoichiometric ratio into the catalyst to purge oxygen trapped in the ceric oxide. Consequently, the response of the A/F ratio downstream of the catalyst is improved, and the concentration of NOx which has increased in the lean A/F state can be rapidly corrected. FIG. 7 shows respective time charts of the changes in the A/F ratios upstream of and downstream of the catalyst, the output of the $O_2$ sensor in the exhaust gas downstream of the catalyst, and the concentration of HC and CO downstream of the catalyst in the case when the A/F ratio upstream of the catalyst has been corrected from a rich ratio to a lean ratio according to the method of the present invention. As well as in the case when the lean A/F ratio is corrected to a rich ratio, if the A/F ratio becomes richer beyond a predetermined efficient-purification range, for example, the highly-efficient-purification range (the region densely shaded in FIG. 7), the oxidizing atmosphere is rapidly strengthened by feeding the exhaust gas with the A/F ratio leaner than the stoichiometric ratio into the catalyst to trap oxygen in the ceric oxide. Consequently, the concentration of HC and Co which have increased in the rich A/F state can be rapidly corrected. Here, it is necessary to determine the degree of the over-correction for the A/F ratio such that the reaction of the ceric oxide is promoted in the catalyst. It is known that the lattice spacing of ceric oxide increases in accordance with the increase of its temperature, which in turn degrades the $O_2$-trapping performance of ceric oxide. Therefore, the degree of the over correction for the A/F ratio must be determined corresponding to the degradation degree of the ceric oxide. Several methods, which have been practical, of estimating the degradation degree of the ceric oxide are disclosed in Japanese Patent Application Laid-Open Hei 5-171924 and so on. Although the degree of the over-correction is mainly determined corresponding to the degradation degree of the ceric oxide, the accuracy in the control can be improved by determining the degree of the over-correction by taking the operational conditions and the temperature of the catalyst also into account.

Since it is desirable in the conventional F/B control of the A/F ratio that changes in the A/F ratio are retained within the highly-efficient-range, the variation $\Delta$(A/F) of the controlled variable A/F ratio is about 0.2. On the other hand, it is preferable from the standpoint of quick response of the A/F ratio downstream of the catalyst that the A/F ratio is corrected in the dynamic range such that the A/F ratio deviates from the highly-efficient-purification range by the method according to the present invention. Further, since the conventional control method is aimed at controlling the A/F ratio in the upstream of region of the catalyst, that is, the outlet region of the engine, the control period is determined by the transfer characteristics from the injection valve or throttle valve to the $O_2$ sensor at the inlet of the catalyst, that period is about 0.1–1 s. On the other hand, in the control method according to the present invention, the control period is mainly determined by the A/F transfer characteristics before and after the catalyst, and that period is longer than that in the conventional control method. Further, since the control according to the present invention is performed to compensate the response delay of the purification due to the ceric oxide, the correction feed of oxidizing or deoxidizing material is sometimes brought to and end after several times feeding of such material assuming that the above material is fed into the catalyst sufficiently to make the reaction rate of the ceric oxide maximum even if the output of the $O_2$ sensor is not settled within a predetermined range. The above points in the control according to the present invention are different from the conventional F/B control methods of controlling the A/F ratio.

As mentioned above, the present invention provides a method of quickly correcting the degradation of the exhaust gas by controlling the injection amount or the amount of intake air so that the best response of the A/F ratio downstream of the catalyst can be obtained, if the A/F ratio downstream of the catalyst deviates from the optimal region. In this control, since oxidizing or deoxidizing material is sometimes fed into the catalyst with an amount more than that corresponding to the stoichiometric A/F ratio, or that necessary to balance the amounts of $Ce_2O_3$ and $CeO_2$ in the catalyst, the balance of the amounts of $Ce_2O_3$ and $CeO_2$ is not always optimal after the convergence of this control. Therefore, although it is effective to keep the balance of the amounts of $Ce_2O_3$ and $CeO_2$ optimal after the A/F ratio downstream of the catalyst converges within the optimal range, such methods have been devised as aforementioned.

Figure 9:
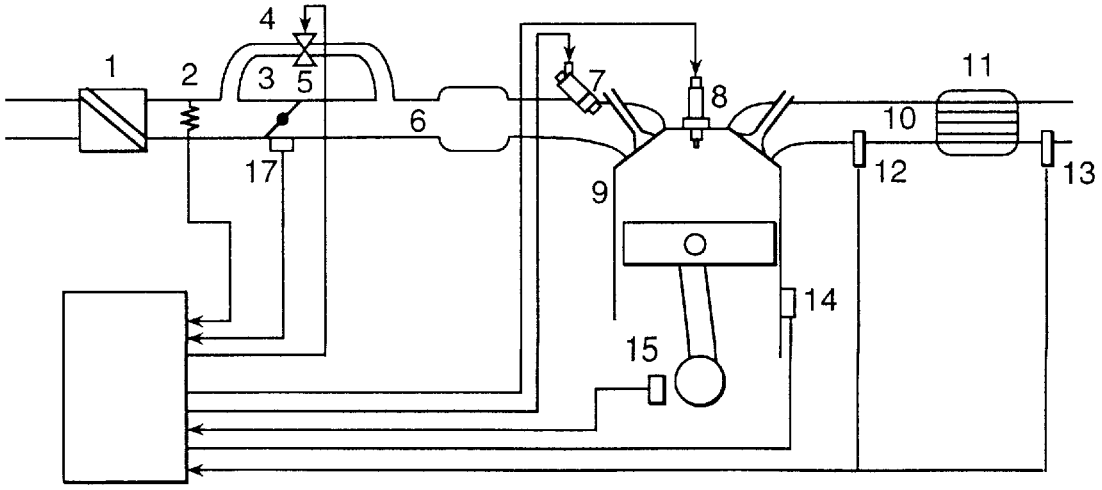
FIG. 9 is a schematic diagram showing the composition of an engine system to which the apparatus of the embodiment is applied.

FIG. 9 schematically shows the composition of an engine system to which the apparatus of an embodiment is applied. In the engine composed of a plurality of cylinders, the air taken in from the outside passes through an air cleaner 1, and flows into a combustion chamber via an intake-air manifold 6. Although the intake air is mainly adjusted by a throttle valve 3, the rotational speed in the engine is controlled by adjusting the amount of the intake air with an ISC valve 5 located in an air bypass 4. The amount of the intake air is detected by an air flow sensor 2. A pulse signal is output from a crank angle sensor 14 at every rotation of the crank axis. A water temperature sensor 14 detects the temperature of engine-cooling water. Respective signals output from the air flow sensor 2, an opening angle sensor 17 attached to the throttle valve 3, the crank angle sensor 15, and the water temperature sensor 14 are transmitted to a control unit 16. Further, the operational state of the engine is determined based on the signals sent from the sensors, and main manipulated variables such as a fundamental amount of fuel injection, ignition timing, etc., are calculated. The injection amount is converted to a valve-opening pulse signal, and the valve-opening signal is sent to an injection valve 7. An ignition drive signal is sent to an ignition plug 8 so that the ignition is started at the ignition timing determined by the control unit 16. The injected fuel is mixed with the air introduced from the intake air manifold 6. Further, the injected fuel and the air flows into the combustion chamber of the engine 9, and the mixture is created. The created mixture explodes with a spark generated by the ignition plug 8, and the energy generated by the explosion is used for the power driving the engine 9. The exhaust gas generated after the explosion is sent to the catalyst 11 via an exhaust manifold 10, and is purified by the catalyst 11. The purified exhaust gas is further expelled to the outside. An A/F sensor 12 is located between the engine 9 and the catalyst 11, and the A/F sensor 12 has the linear output characteristics with respect to the concentration of oxygen in the exhaust gas. The relationship between the A/F ratio and the oxygen concentration in the exhaust gas is linear, and the A/F ratio can be obtained from the output of the A/F sensor. Moreover, an $O_2$ sensor 13 is located downstream of the catalyst 11, and the A/F ratio downstream of the catalyst 11 can be detected by the $O_2$ sensor 13. While the control unit 16 calculates the A/F sensor upstream of the catalyst 11 with the signal sent from the A/F sensor 12 and performs a F/B control to correct the fundamental injection amount in succession based on the calculated A/F ratio so that the A/F ratio in the chamber of the engine 9 attains the desired A/F ratio, the control unit 16 also performs a control to excessively correct the A/F upstream of the catalyst 11 so that the output of the $O_2$ sensor 13 is held within a predetermined range when the output of the sensor 13 deviates from the predetermined range. Here, the A/F ratio obtained with the output of the $O_2$ sensor 13 can be used for the above F/B control in place of the A/F sensor 13.

Figure 10:
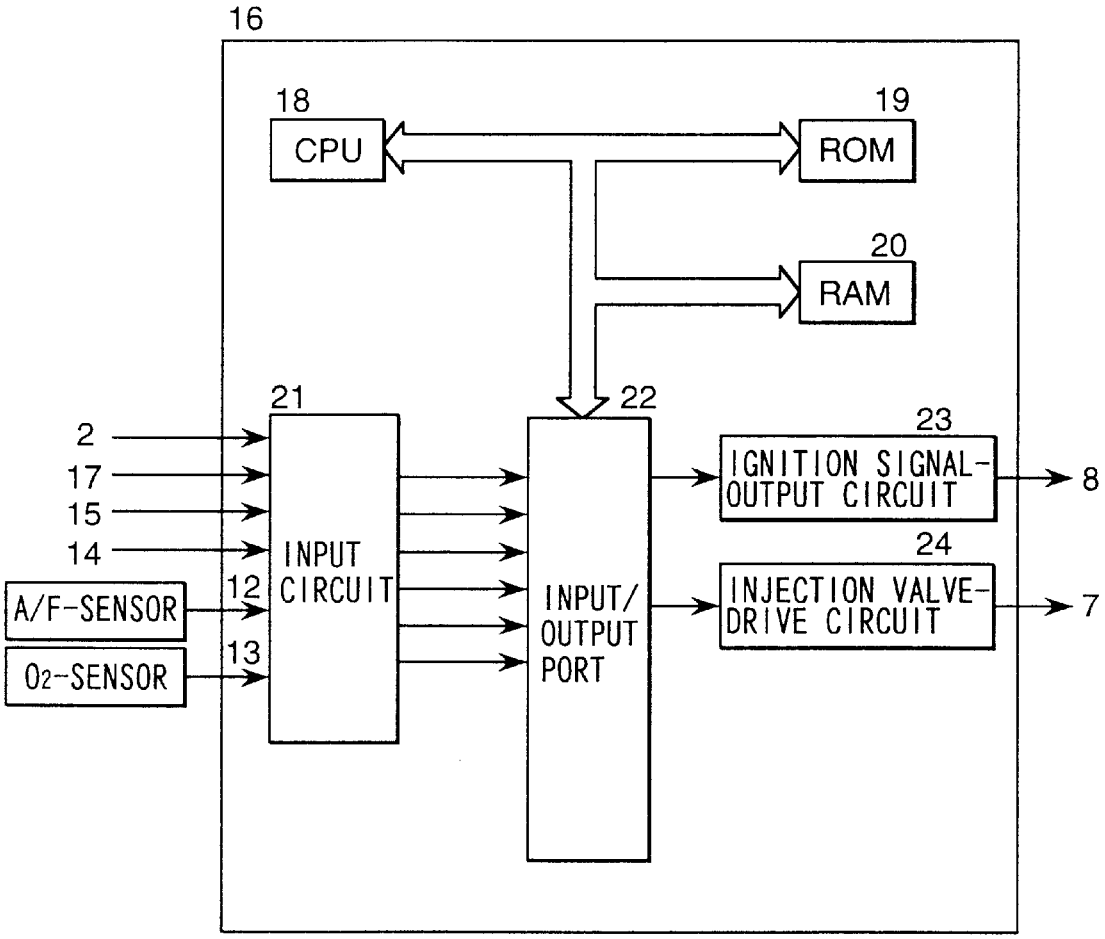
FIG. 10 is a schematic block diagram showing the composition of the control unit shown in FIG. 9.

FIG. 10 shows a schematic block diagram of the composition of the control unit 16. The respective output signals of the A/F sensor 12, the $O_2$ sensor 13, the throttle-valve opening degree sensor 17, the air flow sensor 2, the rotational speed sensor 15, and the water temperature sensor 14 are input to ECU 16, and the output signals are sent to an input/output port 22 after signal processing such as removal of noises in the output signals is carried out. The values of the output signals sent to the input port 22 are stored in a RAM 20, and are processed by CPU 18. The control program for the processing executed by CPU 18 are memorized in advance in ROM 19. The manipulated amount of each actuator, which has been calculated according to the control program, is stored in RAM 20, and is then sent to the output port 22. An ON/OFF signal is set as the ignition plug-drive signal such that this signal is turned on when current flows in the primary coil in an ignition signal-output circuit 23, and vice versa. The ignition starts at the time pint when the ignition plug-drive signal turns from ON to OFF. The signal for driving the ignition plug 8, which has been set in the output port 22, is amplified by the ignition signal-output circuit 23 so as to possess the energy enough to ignite the ignition plug 8. An ON/OFF signal is set as an injection valve-drive signal such that this signal is turned on in the valve-opening operation, and vice versa. Further, this signal is amplified by an injection valve-drive circuit 24 so as to possess the energy enough to open the injection valve 7.

Figure 11:
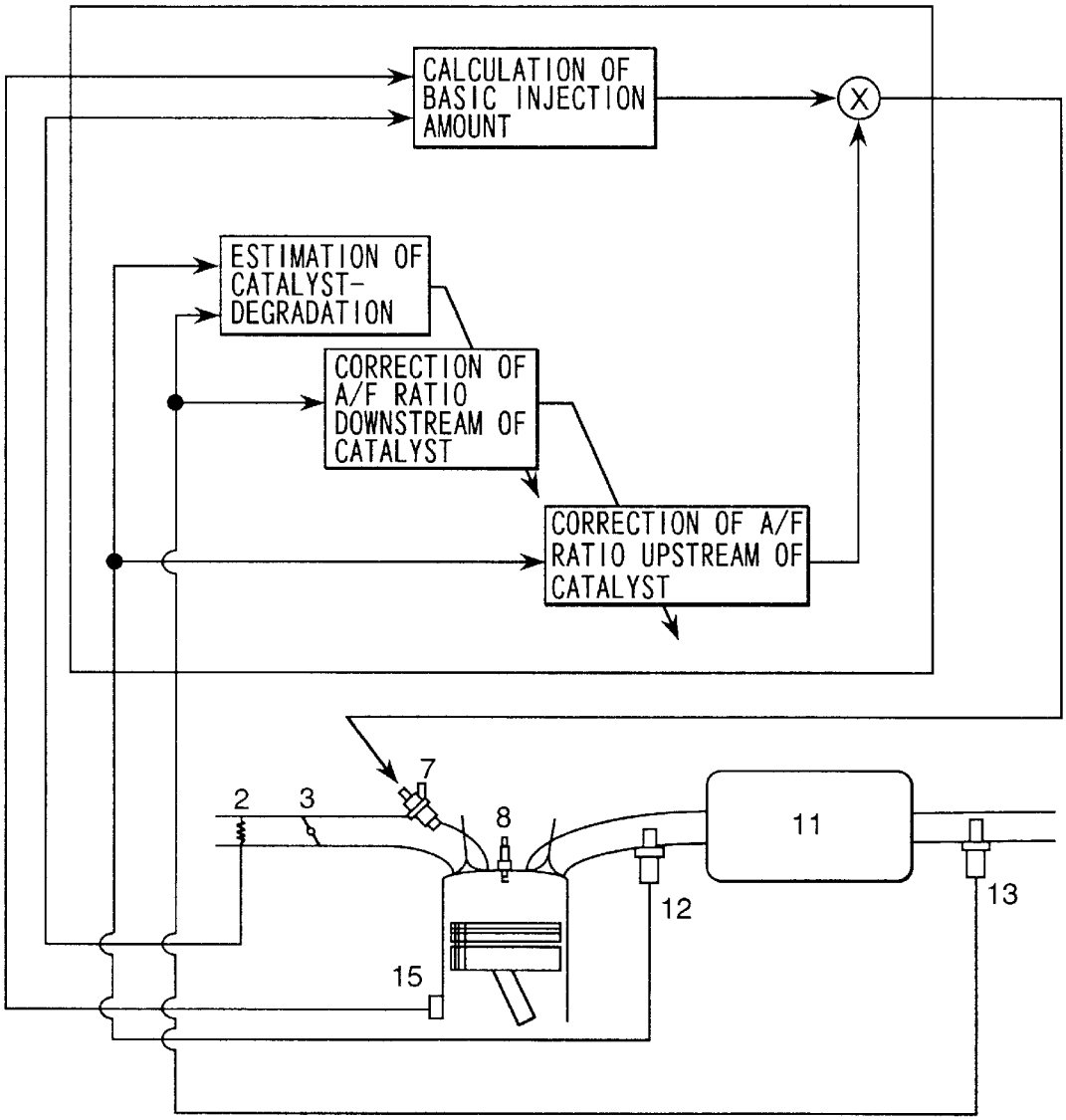
FIG. 11 is a schematic block diagram showing the control method according to the present invention.

The contents of the control program implementing the control method according to the present invention, which is stored in ROM 19, is explained below. FIG. 11 shows a schematic function block diagram of the control method according to the present invention. The fundamental injection amount for each cylinder is calculated by the equation (5) based on the values of the air flow rate detected by the air flow sensor 2 and the rotational speed detected by the engine rotational speed sensor 15.

$$TI=K\cdot(QA/(N\cdot CYL)) \quad (5),$$

where TI: the fundamental injection amount;

k: a characteristic coefficient of the injection valve;

QA: the air flow rate;

N: the rotational speed; and

CYL: the number of cylinders.

Figure 12:
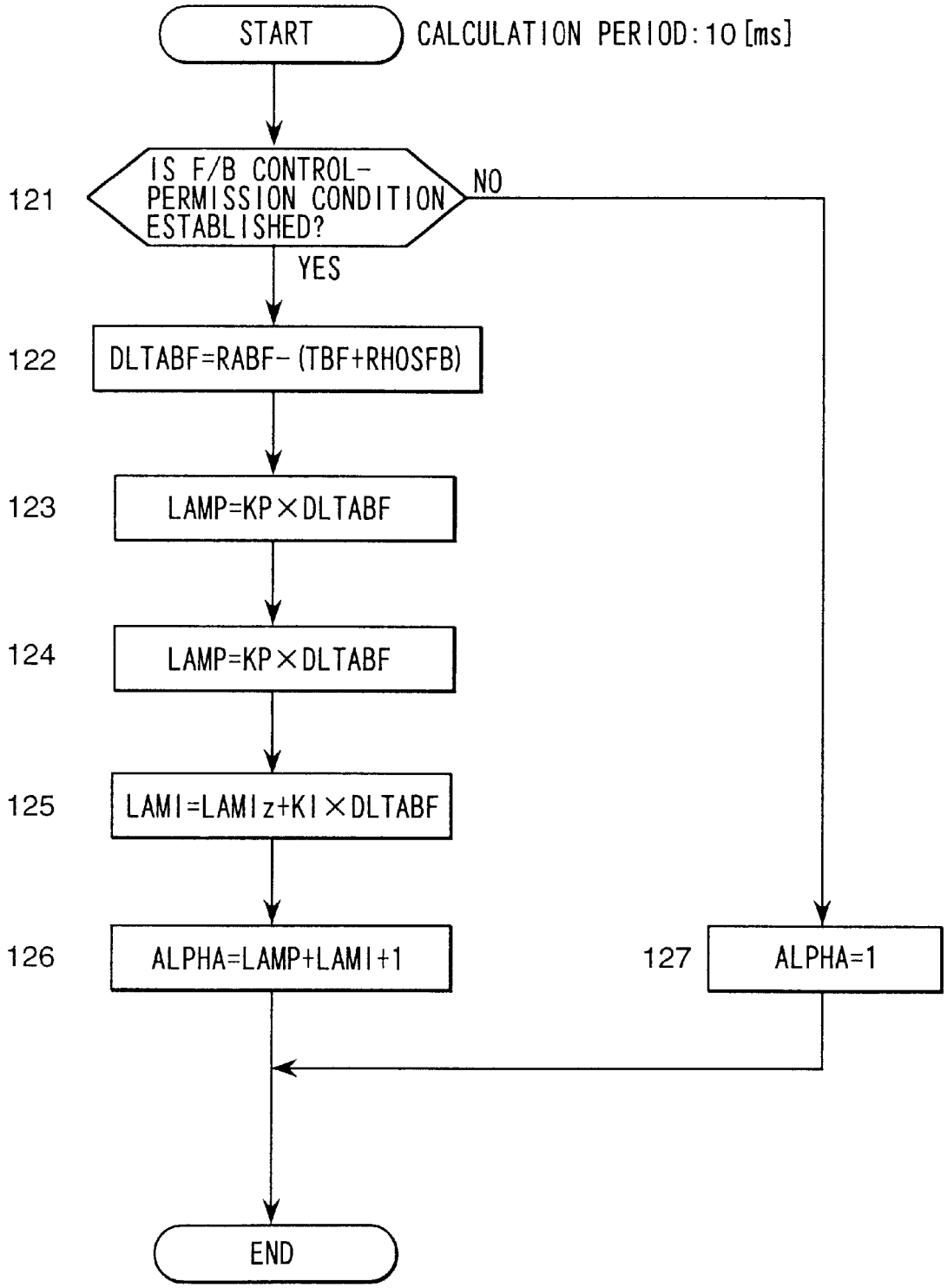
FIG. 12 is a flow chart of the control method of controlling the A/F ratio upstream of the catalyst, which is shown in FIG. 4.

In the following, the processes of the control method of controlling the A/F ratio upstream of the catalyst 11 will be explained with reference to FIG. 12. The objective of this control method is to perform the F/B control for controlling the A/F ratio upstream of the catalyst 11 so as to attain the desired ratio based on the A/F sensor 12 located upstream of the catalyst 11. In step 121, it is determined whether or not the F/B control-permission conditions are established. The F/B control-permission conditions are, for example, that the water temperature is higher than a predetermined value, that the operation is not in the acceleration state, that the sensor is in the activated state, and so on. If the F/B control-permission conditions are not established, the correction term ALPHA for the F/B control is set to 1 in step 127, which means that the correction is not executed. Conversely, if the F/B control-permission conditions are established, the correction term ALPHA is calculated based on the difference DLTABF between the A/F ratio upstream of the catalyst 11, which is obtained based on the output of the A/F sensor 12, and the desired A/F ratio (TABF+RHOSFB), which is attained by a PI control. Here, TABF: the target fundamental A/F ratio, and RHOSFB: the correction term for the control of the A/F ratio downstream of the catalyst 11.

In step 122, DLTABF is calculated, and the proportional correction term LAMP is obtained by multiplying DLTABF by the proportional gain KP in step 123. Next, in step 124, the integral correction term LAMI is calculated by adding the production of DLTABF and the integral gain KI to LAMIz. Here, LAMIz is the value of LAMI which was calculated 10 ms before at the previous calculation step. In step 126, the correction term ALPHA for the F/B control is set to the sum of the proportional correction term LAMP, the integral correction term LAMI, and the median value 1. The above processes are performed to correct the A/F ratio upstream of the catalyst 11.

Figure 13:
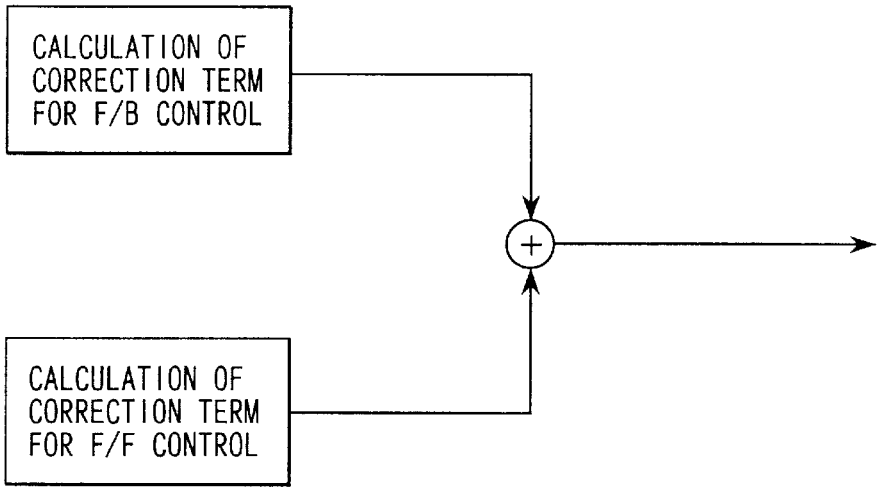
FIG. 13 is a schematic block diagram showing the control method of controlling the A/F ratio downstream of the catalyst, which is shown in FIG. 11.

FIG. 13 shows a schematic function block diagram of the control method of controlling the A/F ratio downstream of the catalyst. The correction block of the A/F ratio downstream of the catalyst 11 is composed of the block for calculating the correction term for the F/B control and the block for calculating the correction term for the F/F control.

Figure 14:
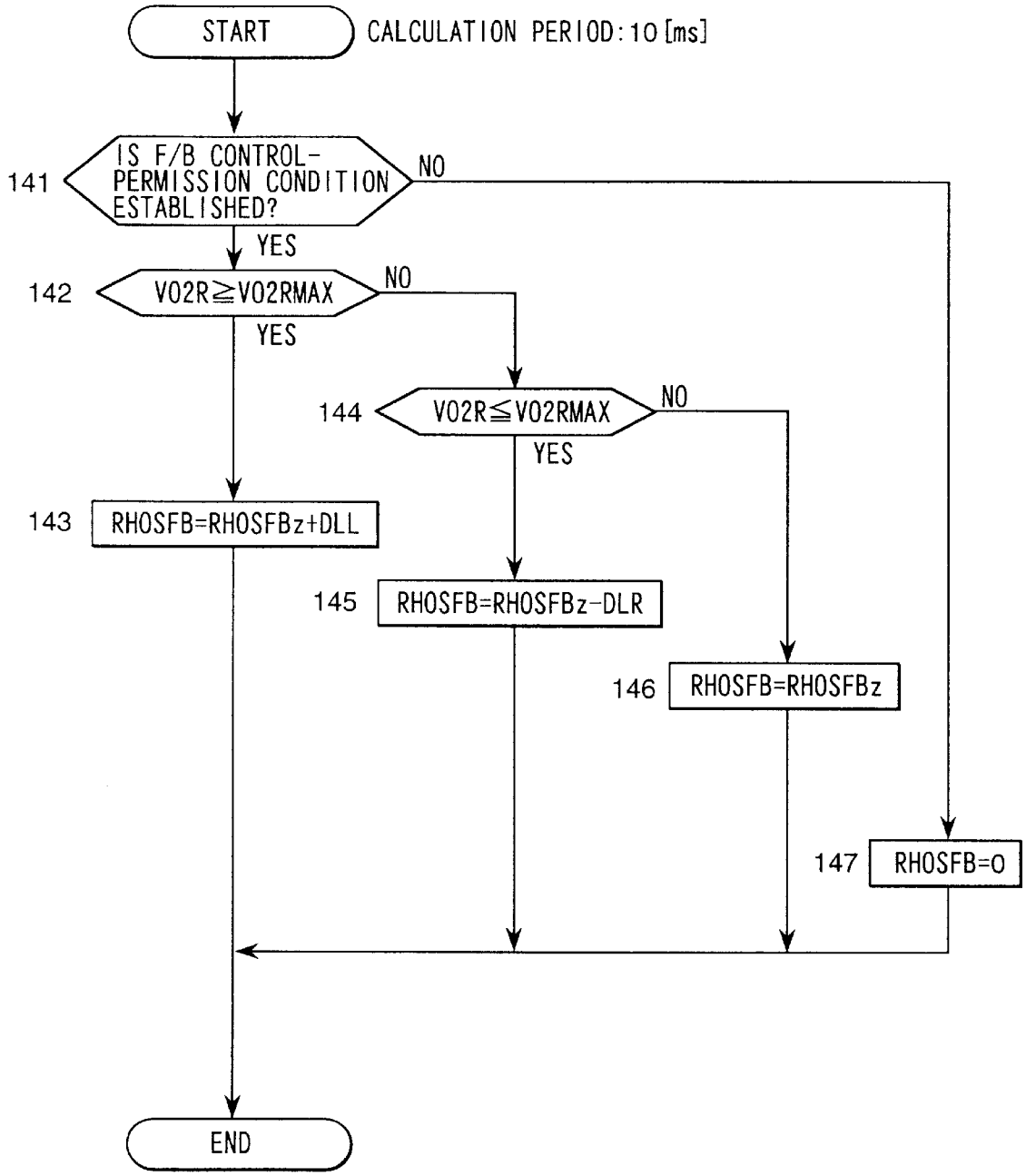
FIG. 14 is a flow chart of the F/B control method of controlling the A/F ratio downstream of the catalyst, which is shown in FIG. 13.

The block for calculating the correction term for the F/B control is explained below with reference to FIG. 14. In the block for calculating the correction term for the F/B control, the correction term RHOSFB is determined such that the output of the $O_2$ sensor 13 located downstream of the catalyst 11 is kept within the predetermined range. First, in step 141, it is determined whether or not the F/B control-permission conditions are established downstream of the catalyst 11. The F/B control-permission conditions are, for example, that the F/B control is performed upstream of the catalyst 11, that the $O_2$ sensor 13 is in the activated state, and so on. If the F/B control-permission conditions are not established, the correction term RHOSFB for the F/B control downstream of the catalyst 11 is set to 0 in step 147, which means that the correction is not executed. If the F/B control-permission conditions are established, it is further determined in step 142 whether or not the following condition is established:

$$VO2R \geqq VO2RMAX \quad (6),$$

where VO2R: the output of the $O_2$ sensor 13 located downstream of the catalyst which indicates a high value when the concentration of oxygen is low; and VO2MAX: the upper limit in the desired range of the output of the $O_2$ sensor 13 located downstream of the catalyst 11. If it is determined in step 142 that the condition (6) is established, since the A/F ratio downstream of the catalyst 11 is rich, the correction term RHOSFB is calculated by the equation (RHOSFB=RHOSFBz+DLL) to set the desired A/F ratio upstream of the catalyst 11 to be a leaner value in step 143. DLL indicates the rate of change in RHOSFB. If the condition (6) is not established in step 142, it is further determined in step 144 whether or not the following condition is established:

$$VO2R \leqq VO2RMIN \quad (7),$$

where VO2RMIN: the lower limit in the desired range of the output of the $O_2$ sensor 13 located downstream of the catalyst 11. If it is determined in step 144 that the condition (7) is established, since the A/F ratio downstream of the catalyst 11 is lean, the correction term RHOSFB is calculated by the equation (RHOSFB=RHOSFBz−DLR) to set the desired A/F ratio upstream of the catalyst 11 to be a leaner value in step 145. DLR indicates the rate of change in RHOSFB. If it is determined in step 144 that the condition (7) is not established, since the A/F ratio downstream of the catalyst 11 is kept within the predetermined range, the correction term RHOSFB is set to the previous value RHOSFBz, that is, the correction term RHOSFB is not renewed. Meanwhile, the initial value of RHOSFB is set to 0.

Figure 15:
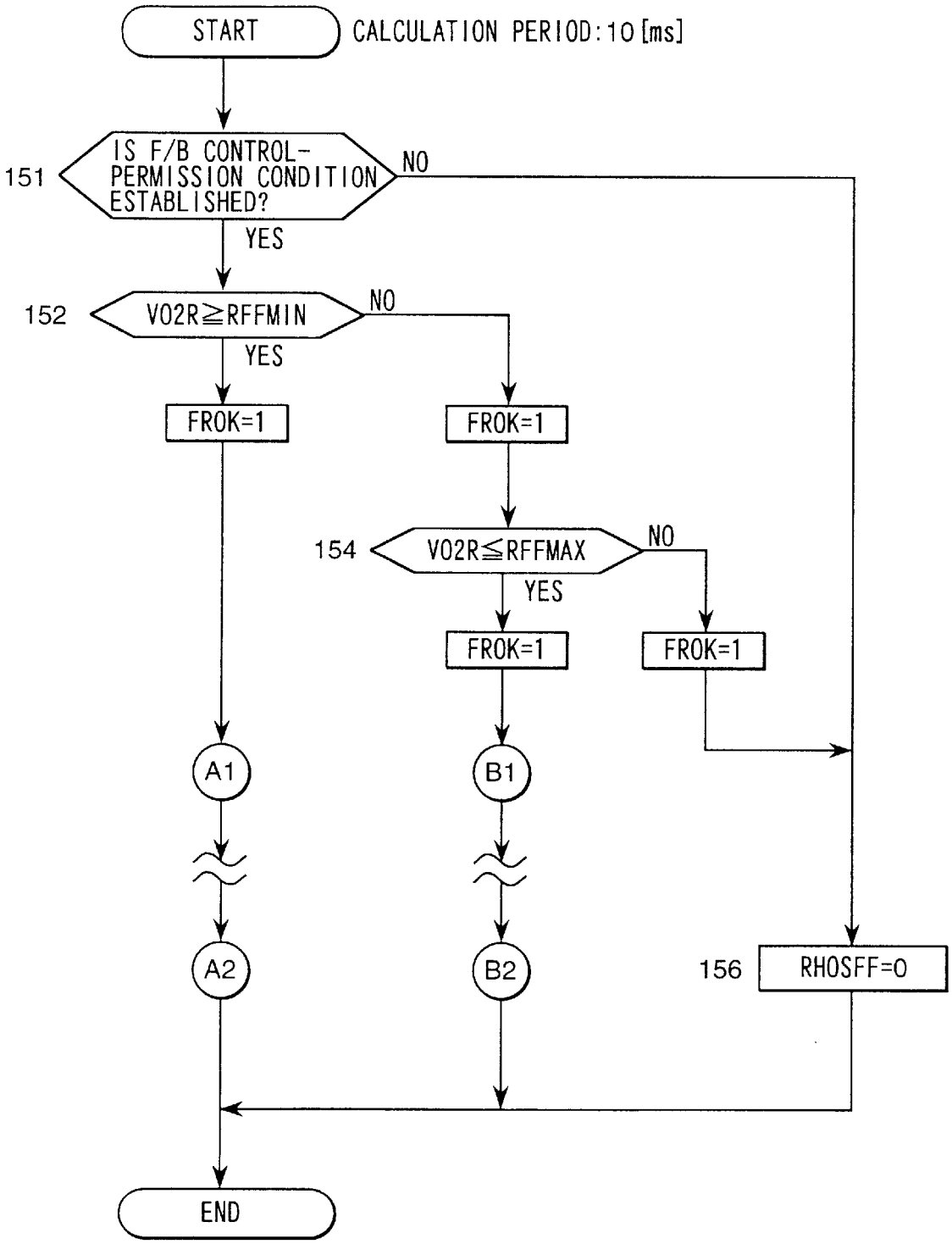
FIG. 15 is a flow chart of the F/F control method of controlling the A/F ratio downstream of the catalyst, which is shown in FIG. 13.

The block for calculating the correction term for the F/F control is explained below with reference to FIG. 15. In step 151, it is determined whether or not the F/F control-permission conditions are established. The F/F control-permission conditions are, for example, that the F/B control-permission conditions are established downstream of the catalyst 11, and so on. If the F/F control-permission conditions are established, the correction term RHOSFF is set to 0 in step 156, and the correction is not performed. If the F/F control-permission conditions are established, the following condition is determined in step 152:

$$VO2R \geqq PFFMIN \quad (8),$$

where PFFMIN: If the condition (8) is established in step 152, the desired A/F ratio upstream of the catalyst 11 is changed by using the control shown in FIG. 16 to quickly return the A/F ratio downstream of the catalyst 11 within the predetermined range. The flow chart shown in FIG. 16 will be explained in detail later. If the condition (8) is not established in step 152, the following condition is determined in step 154:

$$VO2R \leqq PFFMAX \quad (9),$$

where PFFMAX: the maximum value of the A/F ratio at the lean side for starting the F/F control. If the condition (9) is established in step 154, the desired A/F ratio upstream of the catalyst 11 is changed by using the control shown in FIG. 17 to quickly return the A/F ratio downstream of the catalyst 11 within the predetermined range. The flow chart shown in FIG. 17 will be explained in detail later. If the condition (8) is not established in step 154, it is determined that the situation is not in the state in which the F/F control is to be performed, and the correction term RHOSFF is set to 0.

Figure 16:
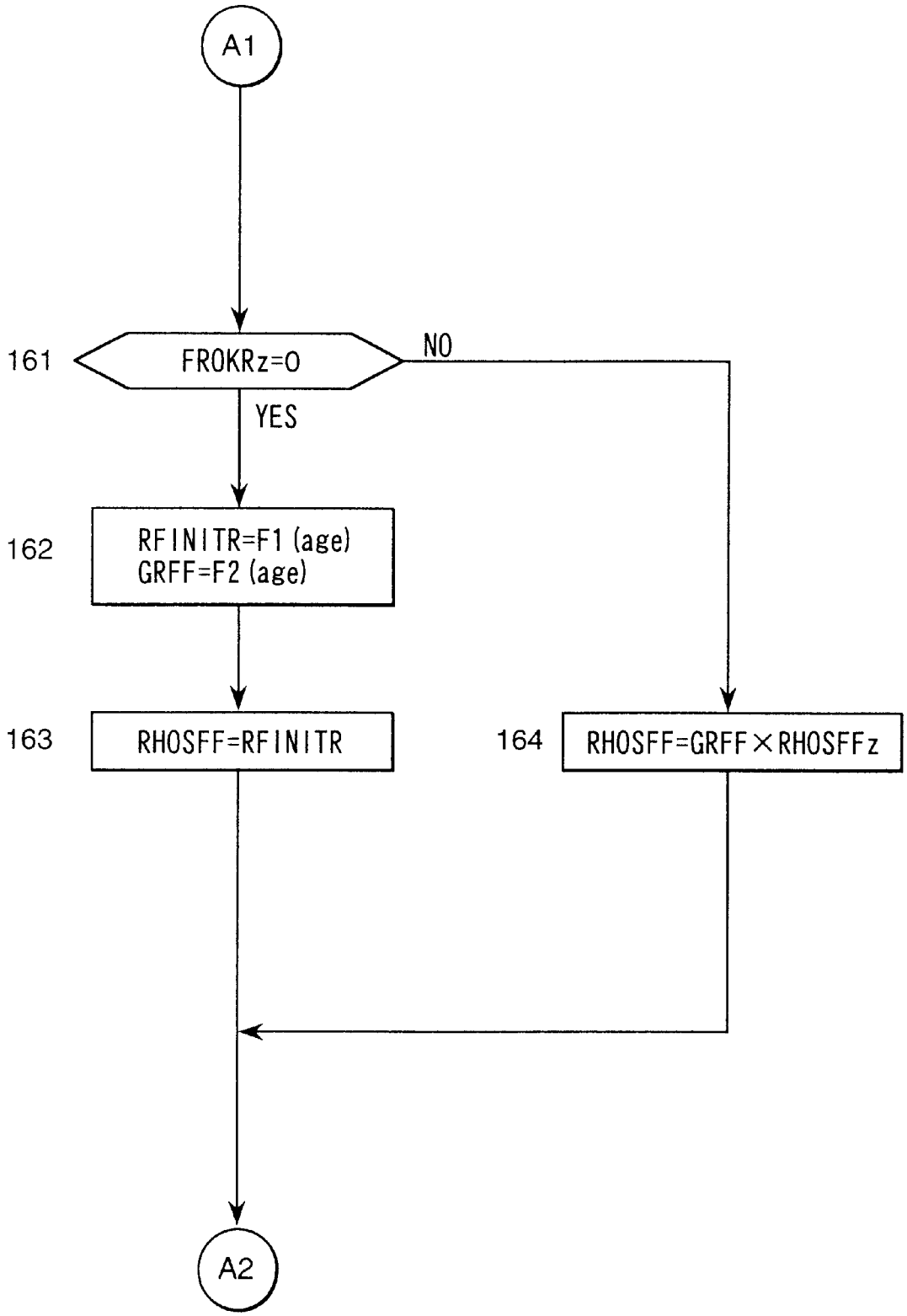
FIG. 16 is a flow chart of the correction method executed when the A/F ratio downstream of the catalyst is richer than the limit value, which is shown in FIG. 15.

The calculation of the correction term at the rich side in the F/F control is explained below with reference to FIG. 16. In FIG. 15, if the condition (8) is established in step 152, it is determined in step 161 whether or not FROKRz=0. This process is for determining whether or not the F/F control-permission conditions are firstly established at this time, and if FROKRz=0, the initial value RFINITR of the correction term and the decreasing coefficient GRFF at the rich side in the F/F control are obtained by the following equations (10) and (11), respectively.

$$RFINITR = F1\ (age) \quad (10)$$

$$GRFF = F2\ (age) \quad (11)$$

Figure 18:
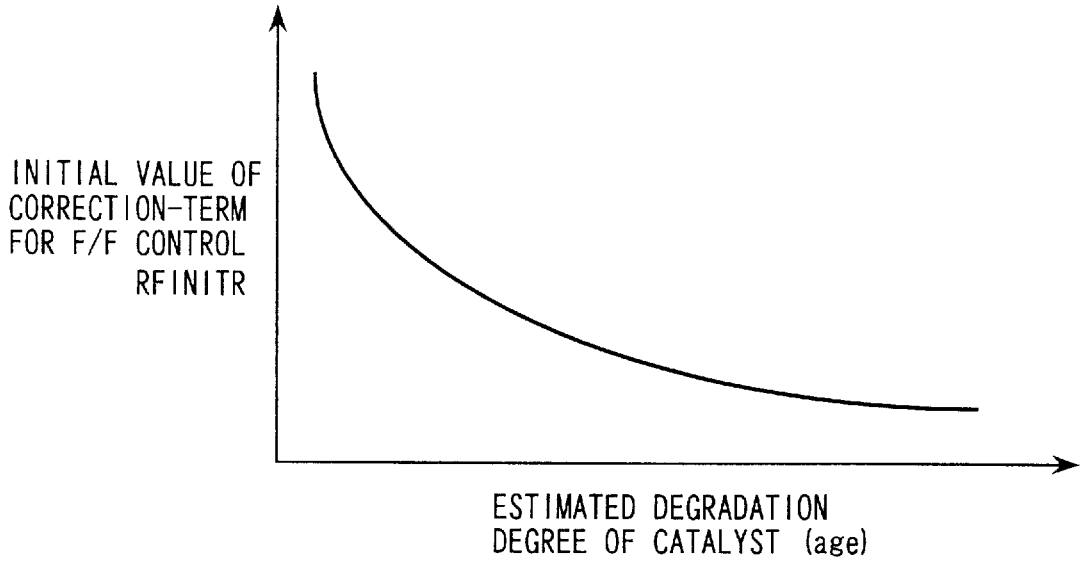
FIG. 18 is a diagram showing the relationship between the estimated degradation degree of the catalyst and the initial value (RFINITR) of the correction term for the F/F control.
Figure 19:
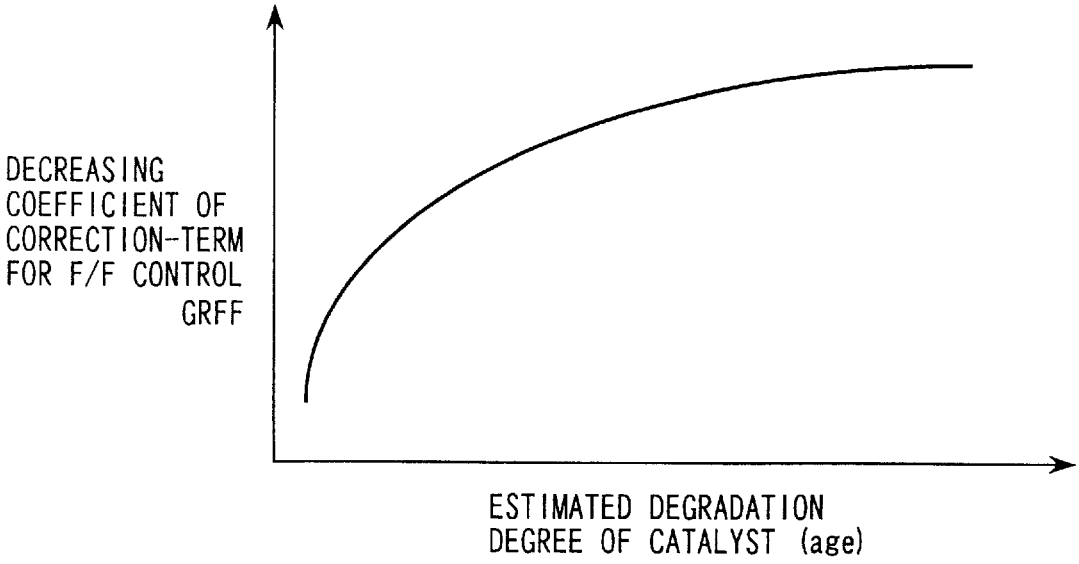
FIG. 19 is a diagram showing the relationship between the estimated degradation degree of the catalyst and the decreasing coefficient (GRFF) of the correction term for the F/F control.

Here, "age" is the estimated degradation degree of the catalyst, and as shown in FIG. 18 and FIG. 19, F1 and F2 are the functions for obtaining RFINITR and GRFF with "age", respectively. It is also possible to use tables for F1 and F1 which represent the relationship between the initial value RFINITR of the correction term for the F/F control and the degradation degree of the catalyst, and that between the decreasing coefficient GRFF of the correction term and the degradation degree, respectively. Also, it is possible to use a reaction model of ceric oxide for determining the initial value and the decreasing coefficient of the correction term. Generally, since the lattice spacing of ceric oxide increases while the ceric oxide degrades, the capacity for storing oxygen decreases. Therefore, while "age" increases, the value of RFINITR tends to decrease, as shown in FIG. 18. On the other hand, while "age" increases, the value of GRFF tends to increase, as shown in FIG. 19. Meanwhile, since several methods of obtaining the estimated degradation degree "age" of catalyst are disclosed, for example, in Japanese Patent Application Laid-Open Hei 5-171924, etc., the explanation of such methods are omitted.

Next, in step 163, the initial value of RHOSFF is set to the initial value RFINITR of the correction term at the rich side in the F/F control, which has been obtained in step 162. If FROKRz is not 0 in step 161, RHOSFF is set to the product of RHOSFFz and the previous decreasing coefficient GRFF in step 164.

Figure 17:
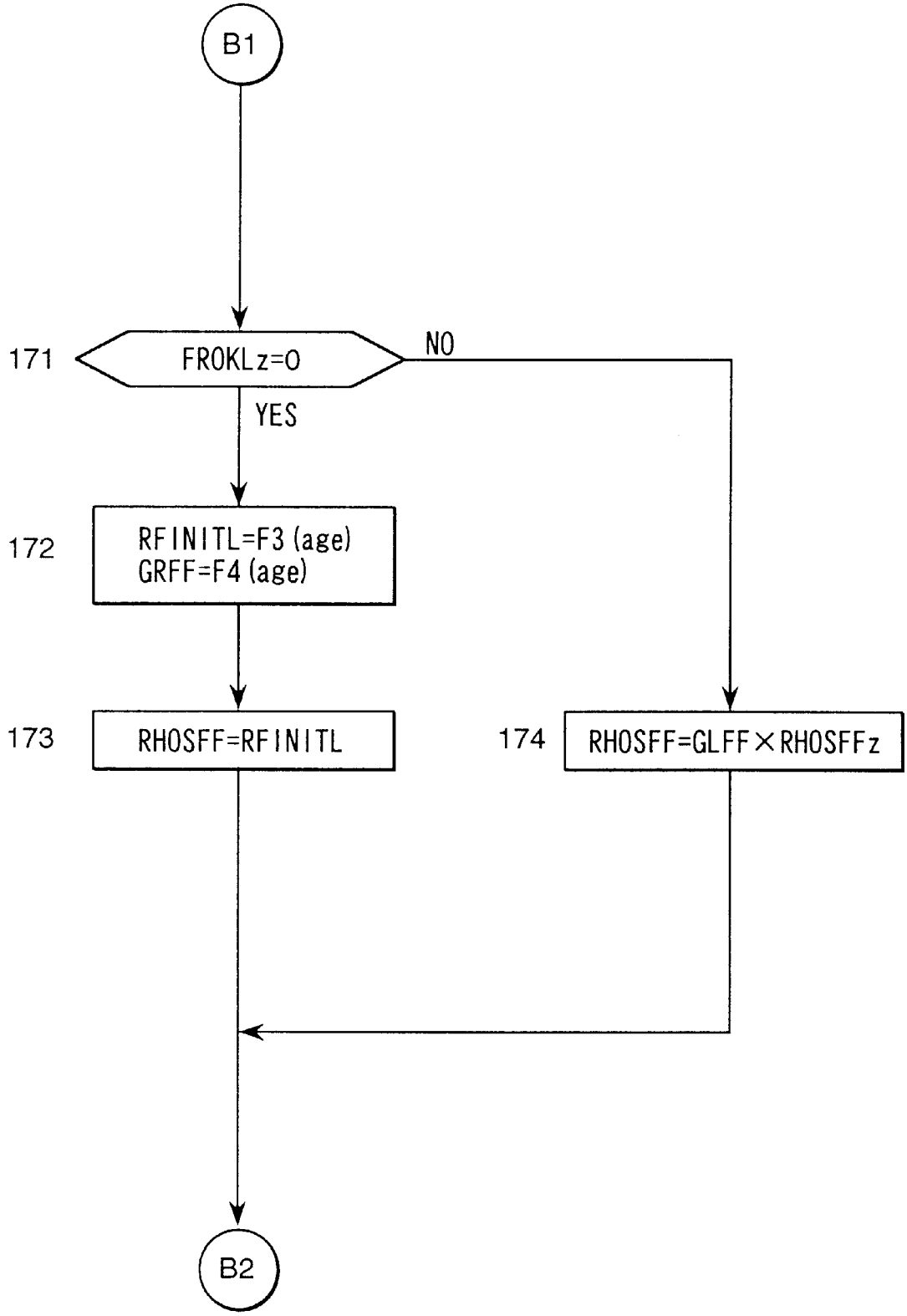
FIG. 17 is a flow chart of the correction method executed when the A/F ratio downstream of the catalyst is leaner than the limit value, which is shown in FIG. 15.

The calculation of the correction term at the lean side in the F/F control is explained below with reference to FIG. 17. In FIG. 15, if the condition (9) is established in step 154, it is determined in step 171 whether or not FROKLz=0. This process is for determining whether or not the F/F control-permission conditions at the lean side are firstly established at this time, and if FROKLz=0, the initial value RFINITR and the decreasing coefficient GRFF of the correction term at the lean side in the F/F control are obtained by the following equations (12) and (13), respectively.

$$RFINITL = F3\ (age) \quad (12)$$

$$GLFF = F4\ (age) \quad (13)$$

Figure 20:
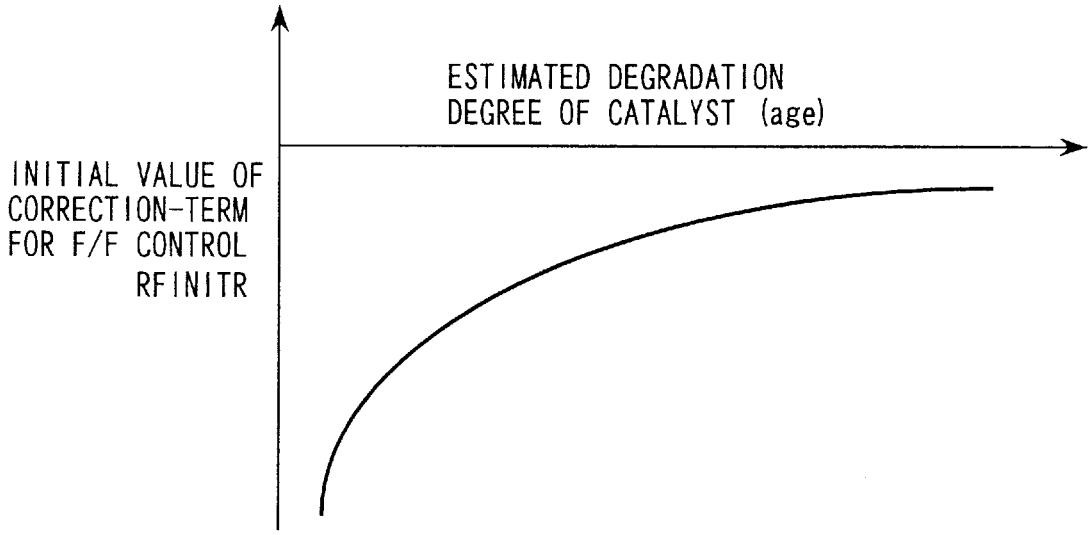
FIG. 20 is a diagram showing the relationship between the estimated degradation degree of the catalyst and the initial value (RFINITL) of the correction term for the F/F control.
Figure 21:
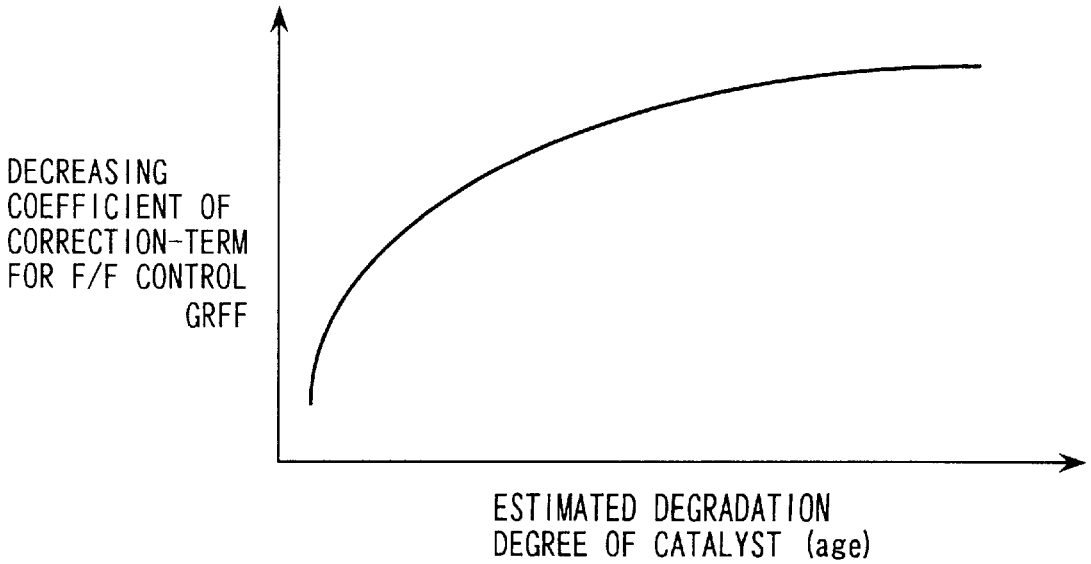
FIG. 21 is a diagram showing the relationship between the estimated degradation degree of the catalyst and the decreasing coefficient (GLFF) of the correction term for the F/F control.

F3 representing the relationship between RFINITL and "age", and F4 representing the relationship between GLFF and "age" are shown in FIG. 20 and FIG. 21, respectively. In step 173, the initial value of RHOSFF is set to the initial value RFINITL of the correction term at the lean side in the F/F control, which has been obtained in step 172. If FROKLz is not 0 in step 171, RHOSFF is set to the product of RHOSFFz and the previous decreasing coefficient GLFF in step 174.

Figure 22:
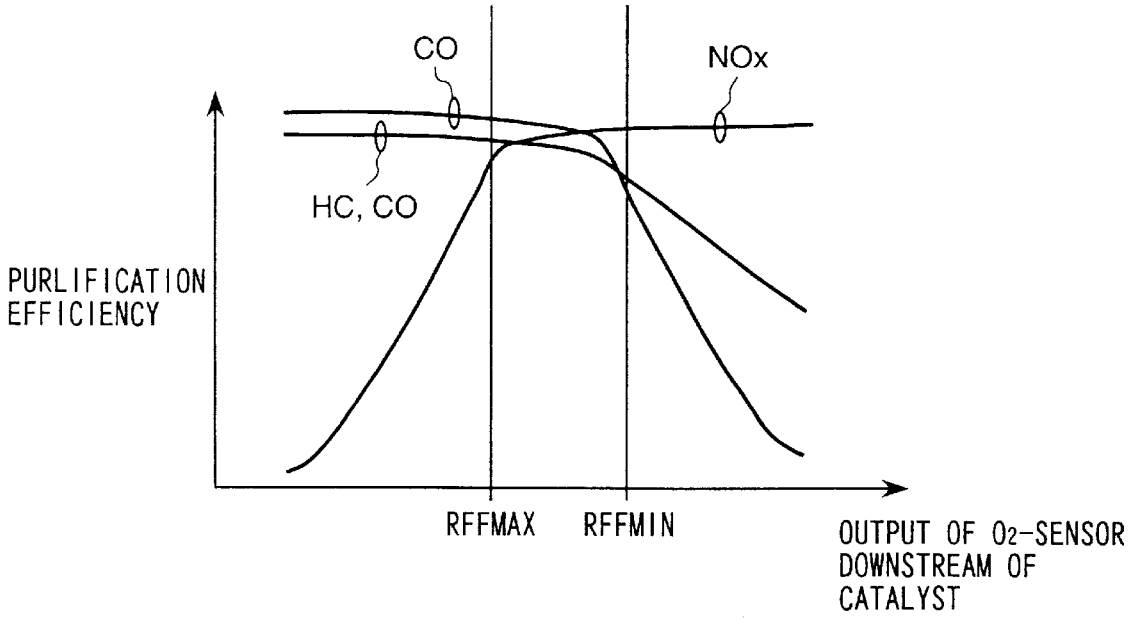
FIG. 22 is an illustration showing the setting of RFFMAX and RFFMIN.

Here, the values of PFFMIN and PFFMAX determining the region in which the F/F control is to be performed can be obtained from the output values of an $O_2$ sensor, from which the purification efficiency of the exhaust gas rapidly degrades in the relationship between the purification efficiency and the output of an $O_2$ sensor such as that shown in FIG. 22.

Figure 23:
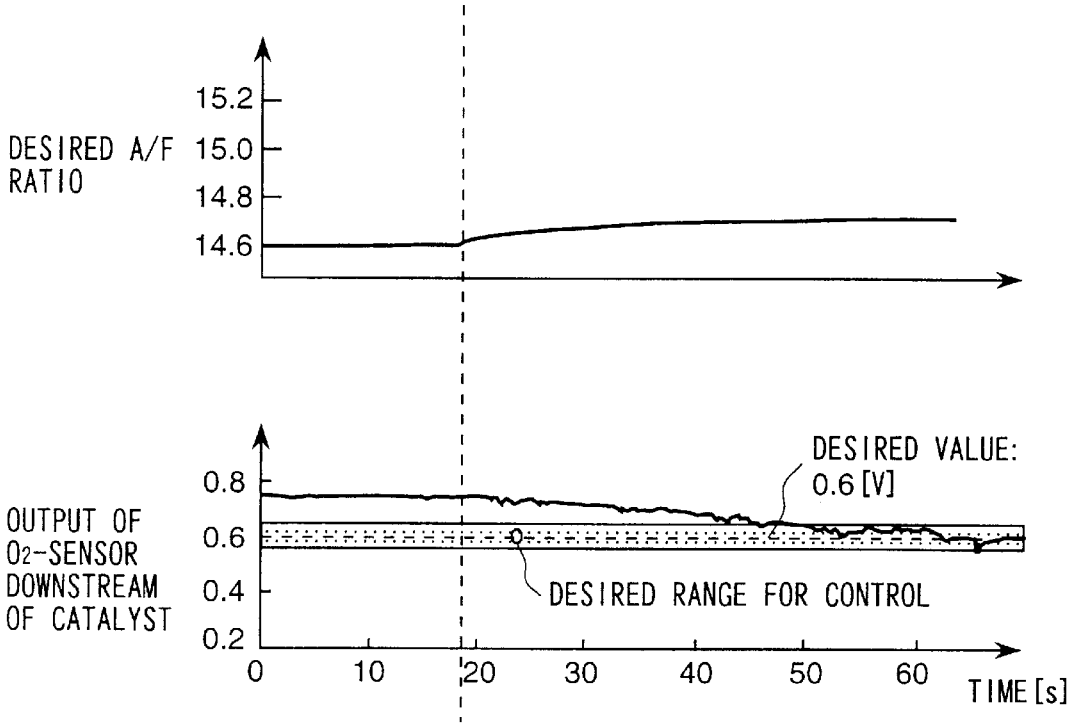
FIG. 23 is a graph showing changes in the output of the $O_2$ sensor, without the control method according to the present invention.
Figure 24:
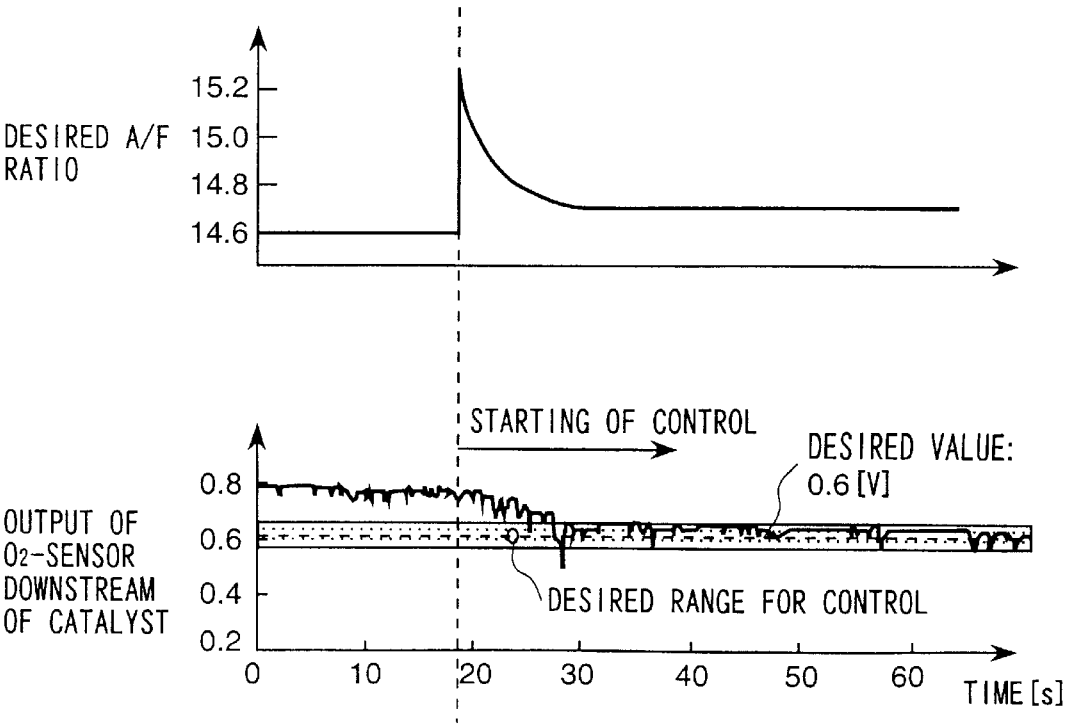
FIG. 24 is a graph showing changes in the output of the $O_2$ sensor, with the control method according to the present invention.

FIG. 23 shows an example of changes in the desired A/F ratio and the output of an $O_2$ sensor in the A/F ratio control using a conventional method, and FIG. 24 shows an example of changes in the desired A/F ratio and the output of an $O_2$ sensor in the A/F ratio control using the method according to the present invention. The change of the output of the $O_2$ sensor, which is shown in FIG. 24, more quickly returns to within the desired control-range than that which is shown in FIG. 23.

Although the above F1–F4 are the functions of only "age", if the values of PFFMIN and PFFMAX are determined by taking the operational conditions of the engine and the temperature or the estimated temperature of the catalyst 11 into account, a more accurate control can be obtained. Moreover, it is also possible to bring the F/F correction of the A/F ratio downstream of the catalyst 11 to an end when the corrections are carried out by the predetermined times, even if the output of the $O_2$ sensor downstream of the catalyst 11 does not return within the predetermined range. This feature of the control according to the present invention is not seen in the conventional controls in which the F/B control is performed based on the output of an $O_2$ sensor.

Thus, in accordance with the present invention, since the deviation of the A/F ratios above and below the catalyst 11, which frequently occurs during the running of a car, can be quickly corrected, the quality degradation of the exhaust gas due to substances such as HC, CO, Nox, etc., generated during the occurence of the above deviation can be prevented to a minimum.

What is claimed is:

1. An air-to-fuel ratio control apparatus comprising:

a catalyst unit for purifying exhaust gas from an engine;

air-to-fuel ratio-detection means for detecting at least an air-to-fuel ratio downstream of said catalyst unit;

first control means for controlling at least one of an amount of fuel and an amount of air to be fed to said engine by using a feed-back control based on at least one of air-to-fuel ratios upstream of, downstream of, and in said catalyst unit; and second control means for controlling an air-to-fuel ratio upstream of said catalyst unit so as to be within a predetermined purification-efficiency range after over-correcting said air-to-fuel ratio upstream of said catalyst unit so as to be a richer value beyond said predetermined purification-efficiency range, if an output of said air-to-fuel ratio-detection means deviates from a predetermined range, and an air-to-fuel ratio downstream of said catalyst unit is lean.

2. An air-to-fuel ratio control apparatus according to claim 1, wherein a manipulated amount of a variable for correcting said air-to-fuel ratio is determined based on a degradation degree of a catalyst in said catalyst unit.

3. An air-to-fuel ratio control apparatus according to claim 1, wherein a manipulated amount of a variable for correcting said air-to-fuel ratio is determined based on one of a temperature value and an estimated temperature value of a catalyst in said catalyst unit.

4. An air-to-fuel ratio control apparatus according to claim 1, wherein a manipulated amount of a variable for correcting said air-to-fuel ratio is determined based on variables indicating an engine's operational state, which include at least a coolant temperature, a rotational speed, and an amount of air taken into an engine.

5. An air-to-fuel ratio control apparatus according to claim 1, wherein said predetermined purification-efficiency range is determined such that a purification efficiency for at least one of HC, CO, and Nox is equal to or more than 50%.

6. An air-to-fuel ratio control apparatus according to claim 1, wherein an air-to-fuel ratio in one of the upstream and the downstream of said catalyst unit is controlled by controlling one of an amount of fuel injected into an engine and an injection-pulse signal sent to an injection valve.

7. An air-to-fuel ratio control apparatus according to claim 1, wherein an air-to-fuel ratio in one of the upstream and the downstream of said catalyst unit is controlled by adjusting an amount of air taken into an engine.

8. An air-to-fuel ratio control apparatus according to claim 2, wherein said degradation degree of said catalyst is calculated based on an output value of said air-to-fuel ratio-detection means located in one of the upstream, the downstream, and the inside of said catalyst unit.

9. An air-to-fuel ratio control method of controlling an air-to-fuel ratio of exhaust gas from an engine by using an apparatus according to claim 2, wherein said degradation degree of said catalyst is calculated based on an output value of said air-to-fuel ratio-detection means located in one of the upstream, the downstream, and the inside of said catalyst unit.

10. An air-to-fuel ratio control apparatus according to claim 7, wherein said adjusting of said amount of said intake air is performed by controlling one of an electrically-controlled throttle valve and a signal for controlling said electrically-controlled throttle valve.

11. An air-to-fuel ratio control apparatus comprising:

a catalyst unit for purifying exhaust gas from an engine;

air-to-fuel ratio-detection means for detecting at least an air-to-fuel ratio downstream of said catalyst unit;

first control means for controlling at least one of an amount of fuel and an amount of air to be fed to said engine by using a feed-back control based on at least one of air-to-fuel ratios upstream of, downstream of, and in said catalyst unit; and second control means for controlling an air-to-fuel ratio upstream of said catalyst unit so as to be within a predetermined purification-efficiency range after over-correcting said air-to-fuel ratio upstream of said catalyst unit so as to be a leaner value beyond said predetermined purification-efficiency range, if an output of said air-to-fuel ratio-detection means deviates from a predetermined range, and an air-to-fuel ratio downstream of said catalyst unit is rich.

12. An air-to-fuel ratio apparatus according to claim 11, wherein a manipulated amount of a variable for correcting said air-to-fuel ratio is determined based on a degradation degree of a catalyst in said catalyst unit.

13. An air-to-fuel ratio apparatus according to claim 11, wherein a manipulated amount of a variable for correcting said air-to-fuel ratio is determined based on one of a temperature value and an estimated temperature value of a catalyst in said catalyst unit.

14. An air-to-fuel ratio apparatus according to claim 11, wherein a manipulated amount of a variable for correcting said air-to-fuel ratio is determined based on variables indicating an engine's operational state, which include at least a coolant temperature, a rotational speed, and an amount of air taken into an engine.

15. An air-to-fuel ratio apparatus according to claim 11, wherein said predetermined purification-efficiency range is determined such that a purification efficiency for at least one of HC, CO and Nox is equal to or more than 50%.

16. An air-to-fuel ratio apparatus according to claim 11, wherein an air-to-fuel ratio in one of the upstream and the downstream of said catalyst unit is controlled by controlling one of an amount of fuel injected into an engine and an injection-pulse signal sent to an injection valve.

17. An air-to-fuel ratio apparatus according to claim 11, wherein an air-to-fuel ratio in one of the upstream and the downstream of said catalyst unit is controlled by adjusting an amount of air taken into an engine.

18. A method of controlling an air-to-fuel ratio in exhaust gas from an engine by using a control apparatus including a catalyst unit for purifying exhaust gas from an engine, said method comprising the steps of:

detecting at least an air-to-fuel ratio downstream of said catalyst unit;

controlling at least one of an amount of fuel and an amount of air to be fed to said engine by using a feed-back control based on at least one of air-to-fuel ratios upstream of, downstream of, and in said catalyst unit; and controlling an air-to-fuel ratio upstream of said catalyst unit so as to be within a predetermined purification-efficiency range after over-correcting said air-to-fuel ratio upstream of said catalyst unit so as to be a richer value beyond said predetermined purification-efficiency range, if an output of said air-to-fuel ratio-detection means deviates from a predetermined range, and an air-to-fuel ratio downstream of said catalyst unit is lean.

19. A method of controlling an air-to-fuel ratio in exhaust gas from an engine by using an apparatus including a catalyst unit for purifying exhaust gas from an engine, said method comprising the steps of:

detecting at least an air-to-fuel ratio downstream of said catalyst unit;

controlling at least one of an amount of fuel and an amount of air to be fed to said engine by using a feed-back control based on at least one of air-to-fuel ratios upstream of, downstream of, and in said catalyst unit; and controlling an air-to-fuel ratio upstream of said catalyst unit so as to be within a predetermined purification-efficiency range after over-correcting said air-to-fuel ratio upstream of said catalyst unit so as to be a leaner value beyond said predetermined purification-efficiency range, if an output of said air-to-fuel ratio-detection means deviates from a predetermined range, and an air-to-fuel ratio downstream of said catalyst unit is rich.

* * * * *